US008613182B2

(12) United States Patent
D'Agostino

(10) Patent No.: US 8,613,182 B2
(45) Date of Patent: Dec. 24, 2013

(54) CERAMIC TILE FLOOR

(76) Inventor: Joseph D. D'Agostino, Grand Island, NY (US)

( * ) Notice: Subject to any disclaimer, the term of this patent is extended or adjusted under 35 U.S.C. 154(b) by 212 days.

(21) Appl. No.: 12/815,633

(22) Filed: Jun. 15, 2010

(65) Prior Publication Data

US 2011/0302855 A1 Dec. 15, 2011

(51) Int. Cl.
*E04B 1/00* (2006.01)

(52) U.S. Cl.
USPC ..... 52/747.11; 52/309.17; 52/309.12; 52/309.3

(58) Field of Classification Search
USPC ..... 52/309.3, 177, 384, 385, 403.1, 52/389–392; 428/43; 156/71
See application file for complete search history.

(56) References Cited

U.S. PATENT DOCUMENTS

| | | | | |
|---|---|---|---|---|
| 1,796,272 | A * | 3/1931 | Stanbrough | 52/385 |
| 3,364,058 | A | 1/1968 | Wagner et al. | |
| 3,765,972 | A | 10/1973 | Wesp | |
| 4,698,249 | A | 10/1987 | Brown | |
| 5,116,439 | A * | 5/1992 | Raus | 156/71 |
| 5,188,874 | A | 2/1993 | Kauffman et al. | |
| RE34,357 | E | 8/1993 | Eckert et al. | |
| 5,501,895 | A | 3/1996 | Finley et al. | |
| 5,518,799 | A * | 5/1996 | Finestone et al. | 428/137 |
| 5,578,363 | A | 11/1996 | Finley et al. | |
| 6,413,335 | B1 | 7/2002 | Drake, Jr. | |
| 6,630,041 | B1 | 10/2003 | Reiber | |
| 6,698,149 | B1 | 3/2004 | Ruchgy | |
| 6,790,042 | B2 * | 9/2004 | Worth | 434/75 |
| 6,854,241 | B1 | 2/2005 | Pelosi, Jr. | |
| 7,194,843 | B2 | 3/2007 | Pacione | |
| 7,488,523 | B1 | 2/2009 | Muncaster et al. | |
| 7,520,948 | B2 | 4/2009 | Tavy et al. | |
| 7,536,835 | B2 | 5/2009 | Schluter | |
| 7,543,417 | B2 | 6/2009 | McIntosh et al. | |
| 2005/0183370 | A1 | 8/2005 | Cripps | |
| 2005/0223664 | A1 | 10/2005 | Gardner | |
| 2007/0151184 | A1 | 7/2007 | Wise et al. | |
| 2009/0218030 | A1 | 9/2009 | LaVietes et al. | |

OTHER PUBLICATIONS

3M Corp., "3M 425 Aluminum Foil Tape," web page of 3M Corp./Uline.com, 2012.
United States Gypsum Company, "Crack-Isolation System—Installation Guide", brochure, 2007, pp. 1-7.

* cited by examiner

*Primary Examiner* — Brian Glessner
*Assistant Examiner* — Patrick Maestri
(74) *Attorney, Agent, or Firm* — James C. Simmons

(57) ABSTRACT

An article for applying to a floor substrate for preparing the floor substrate for laying of ceramic tiles by bonding ceramic tiles to the article. The article comprises a tile backer board for application to a floor substrate and a sheet bonded to the backer board for bonding of ceramic tiles to the sheet. The sheet comprises a plurality of layers bonded together wherein separation of the sheet along layers thereof is effected for removal of laid ceramic tiles from the backer board. Alternatively, the sheet is bonded to a floor substrate, and the ceramic tiles are bonded thereto. Alternatively, the article is a tape with releasable adhesive thereon. The adhesive releasably adheres to the floor substrate, and the ceramic tiles are bonded to the tape. Alternatively, the article comprises sheets which lie on the floor substrate and which float on the floor substrate and to which are bonded the ceramic tiles.

13 Claims, 5 Drawing Sheets

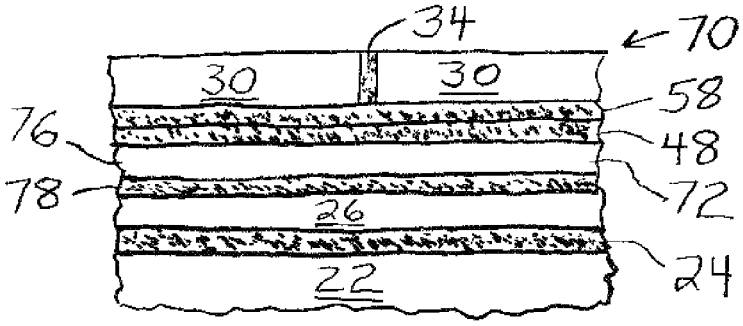
FIG. 8
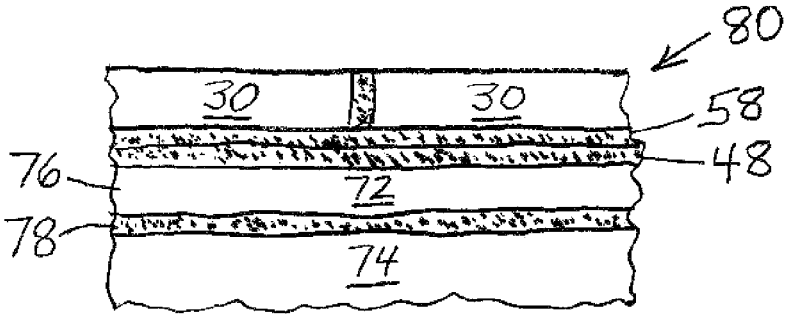
FIG. 9
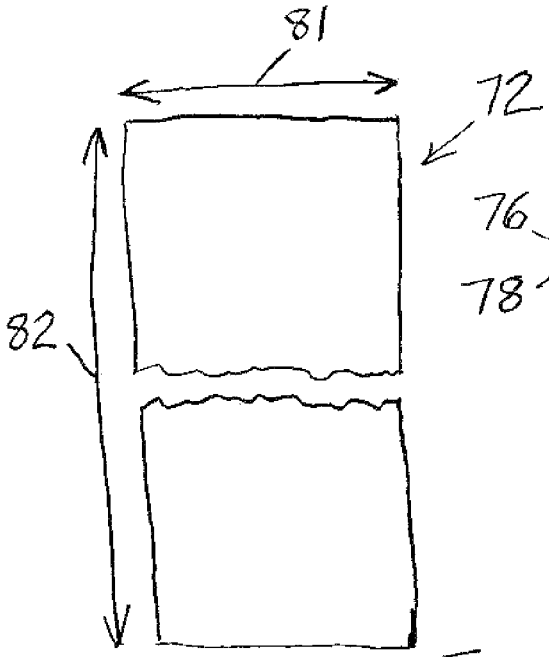
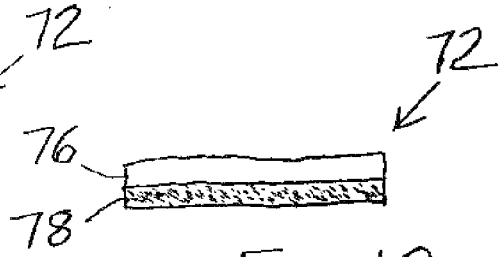
FIG. 10
FIG. 11

CERAMIC TILE FLOOR

The present invention is related generally to flooring. More particularly, the present invention is related to ceramic tile flooring.

In order to have sufficient strength to accept ceramic tile, an underlying floor may need to be built-up. For example, it may be necessary to add backer board or a second layer of plywood to a plywood floor. A backer board is a strong dense board (typically 3×5 or 4×4 feet and typically ¼ to ½ inch thick) typically laid on and bonded with conventional latex-modified thinset mortar and attached by screws, nails, or other fasteners to a wood floor to add strength thereto and to support tile so that it doesn't crack. By "latex-modified" is meant the addition of latex or other suitable polymers, in a manner in accordance with principles commonly known to those of ordinary skill in the art to which the present invention pertains, to the thinset mortar to increase its bonding strength. Backer board may be composed of cement, dense wood, gypsum material faced with fiberglass, or other suitable material providing the necessary strength and rigidity. A concrete floor is considered to normally have sufficient strength and rigidity that it does not normally require backer board to be applied thereto. When applied to a floor or floor substrate, unless otherwise specified, a backer board is considered herein to be part of the floor or floor substrate.

A tile is a thin (for example, ⅛ to ½ inch thick) usually rectangular or square (for example, 1-foot square) typically decorative member used to cover floors, the tiles abutting each other across the surface of the covered or tiled floor. Two common types of tile commonly used for flooring may be classified as vinyl and ceramic. As used herein and in the claims, the term "ceramic tile" is intended to include tile made of fired clay, brick, concrete, porcelain, marble, travertine, and other stone or slate, and does not include vinyl tile.

Vinyl tiles are sufficiently flexible and have enough "give" that they do not need the extra strength and rigidity afforded by backer boards and therefore can be laid directly on a wood floor.

In a typical laying of a floor, ceramic tiles have been permanently bonded to the concrete, wood, or backer board substrate, and such a tiled floor is considered satisfactory for use. When it is desired to replace the tiles either to selectively replace certain tiles or for re-decorating purposes or otherwise, difficulties are experienced. Removal of tiles off concrete is considered to be difficult (may need a jack hammer or the like), and removal off backer board or wood may damage the backer board or the wood floor.

The attachment of backer board to a hardwood floor for strengthening thereof so that it may accept ceramic tiles may damage the hardwood floor.

Solutions have been proposed for easily removing floor coverings attached to a floor. For example, for carpet, U.S. Pat. No. 5,116,439 discloses a two-component release web secured between a carpet (or other floor covering) and a floor. The web is formed as a laminate of a solid flexible carded fiber membrane to which a solid flexible non-woven spun-bonded fiber membrane is adhered, one membrane being adhered to the carpet during manufacture and the other membrane being glued to the floor during installation. It is further stated that the carpet may be peeled from the floor leaving one membrane secured to the carpet and the other membrane secured to the floor, thus permitting reuse of the carpet in another location and permitting ready installation of a new carpet over the membrane secured to the floor.

This U.S. Pat. No. 5,116,439 also discusses an adhesive carpet installation system which uses a carpet cushion with a "fuzzy" fibrous material bonded to one surface of the cushion. The cushion is glued to the floor surface with the "fuzzy" surface down through use of a pressure sensitive adhesive. The carpet itself is then glued to the upper surface of the cushion using the same pressure sensitive adhesive used to secure the cushion to the floor. It is said that this renders the carpet system totally releasable.

Other U.S. patents/published applications which may be of interest to the present application include U.S. Pat. Nos. Re. 34,357; 3,364,058; 3,765,972; 4,698,249; 5,188,874; 5,501,895; 5,578,363; 6,413,335; 6,630,041; 6,698,149; 6,854,241; 7,194,843; 7,488,523; 7,520,948; 7,536,835; 7,543,417; 2005/0183370; 2005/0223664; 2007/0151184; and 2009/0218030. All of these U.S. patents/published applications and any others disclosed herein are hereby incorporated herein by reference.

Published patent application 2007/0151184 discloses an easy to install and remove tile system for tiles, particularly resilient tiles, such as vinyl, wherein the tiles are adhered to a high modulus high tear strength liner, such as a rigid vinyl film, which is caused to float on (not attached) or is adhered to the substrate. The adhesive adhering the tile to the liner may be adhesive dots applied to each corner of the tile, pressure-sensitive adhesive, or a spray adhesive. Other examples of what might be called a "loose-lay" process are disclosed in the aforesaid U.S. patents/published application U.S. Pat. No. Re. 34,357; 5,188,874; 5,578,363; and 2005/0223664.

Published patent application 2009/0218030 discloses a flooring underlayment membrane bonded to a concrete or wood substrate with thinset mortar (or loose-laid) and tile or stone or slate or other rigid floor covering bonded thereto with thinset mortar. The underlayment membrane comprises two nonwoven fiber mats bonded together with an extrudable thermoplastic resin to provide a combined waterproof membrane and crack isolation membrane.

U.S. Pat. No. 7,520,948 discloses a non-woven fabric which may comprise a synthetic polymer and which is adhered to a floor using an adhesive, and a cementitious bondant (i.e., a skimcoat of thinset mortar) is applied to the fabric, either before or after adhering it to the surface of the floor. A covering in the form of ceramic tile, stone, brick, porcelain, marble, slate, etc. is thereafter bound to the bondant. It is stated that the bondant can be any suitable adhesive, mortar, or other composition or any combination of such substances suitable for fixing the covering to the fabric. The adhesive can be a contact cement or self-stick adhesive faced by a removable waxed paper. It is discussed therein that the non-woven fabric can aid removal of the covering (i.e., tile) at a time following its installation. Examples of non-woven fabrics are said to include randomly-entangled fibrous sheets, chemically-bonded fibrous sheets, thermally-bonded fibrous sheets, and others known in the art. The adhesive may be a contact cement, and the non-woven fabric (underlayer) can have an adhesive (e.g., a self-stick adhesive faced by a removable waxed paper) disposed on the face opposite the bondant. The tile is bound to the fabric by way of a thinset mortar or adhesive set atop a cementitious bondant applied to the fabric. U.S. Pat. No. 7,520,948 suggests that the cohesive strength of the fabric is such that it should tear internally to aid removal of the covering (i.e., ceramic tile or the like) at a time following its installation. It is further stated that in situations in which reversibility of fabric installation is desirable, it is preferable that the adhesive bind the fabric to the surface with little more tenacity than required for stable installation of the fabric and covering and that in a situation such as a ceramic tile floor in which significant stresses, wear, and tear are anticipated, the adhesive must bind the fabric to the surface with sufficient tenacity and stability that the fabric will not significantly separate from the surface under the conditions of normal use.

The above U.S. Pat. No. 7,520,948 importantly does not disclose whether the floor to which the non-woven fabric is adhered is a concrete floor, a wood floor on which backer board has been laid, a hardwood floor, or otherwise. Moreover, U.S. Pat. No. 7,520,948 discusses in very broad and general terms non-woven fabrics and adhesives for application to floors generally without any suggestions as to what items or combination of particular items might be suitable for one type of floor (substrate) and what might be suitable for another type of floor (substrate).

A contact cement or self-stick adhesive is commonly understood to be an adhesive or cement which is sticky (tacky) without any heat or solvent for activation and adheres with light pressure. Such an adhesive may be of a type which forms a permanent or non-removable bond so that the bonded item is not readily removable from the substrate. By suggesting that the non-woven fabric should tear internally to aid removal of the covering, the above U.S. Pat. No. 7,520,948 implies that the adhesive is of a type that permanently bonds the fabric to the floor. Such a product would however undesirably damage a hardwood floor to which the fabric is permanently bonded.

It is accordingly an object of the present invention to provide a surface preparation for a concrete floor or a wood floor overlaid with backer board so that ceramic tiles may be laid thereon such that they are quickly and easily removable and replaceable at a future date.

It is another object of the present invention to provide a surface preparation for a hardwood floor so that ceramic tiles may be laid thereon such that they are quickly and easily removable and replaceable at a future date without damaging the hardwood floor.

It is yet another object of the present invention to provide a kit (combination of materials sold or used together) for use in preparing a substrate to accept ceramic tile in a manner such that it can be easily and quickly installed and removed and replaced.

The above and other objects, features, and advantages of the present invention will be apparent in the following detailed description of the preferred embodiments thereof when read in conjunction with the appended drawings in which the same reference numerals depict the same or similar parts throughout the several views.

BRIEF DESCRIPTION OF THE DRAWINGS

FIG. 8 is a view similar to that of FIG. 1 of a portion of flooring in accordance with another embodiment of the present invention, wherein the flooring substrate includes backer board.

FIG. 9 is a view similar to that of FIG. 1 of a portion of flooring in accordance with the another embodiment of the present invention, wherein the flooring substrate is concrete and does not include backer board.

FIG. 10 is a view similar to that of FIG. 1 of a portion of an article for application to flooring in accordance with the present invention.

FIG. 11 is an illustration of a plan view of the article of FIG. 10.

DETAILED DESCRIPTION OF THE PREFERRED EMBODIMENT(S)

Figure 1:
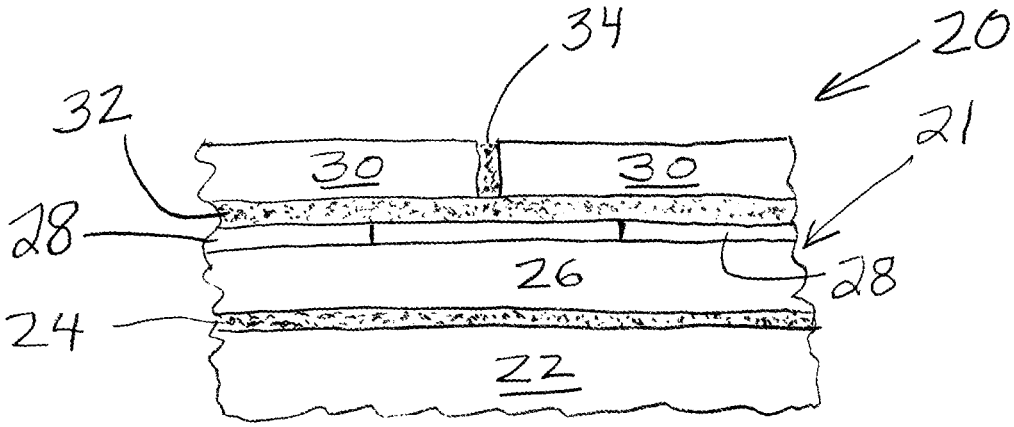
FIG. 1 is an illustration of an edge view of a portion of flooring which embodies the present invention.

Referring to FIG. 1, there is shown generally at 20 a tiled floor which comprises a floor 21 which includes a wood floor substrate 22 to which has been bonded by the use of the aforesaid conventional latex-modified thinset mortar, illustrated at 24, a plurality (one shown) of strengthening backer boards 26. As appropriate, the backer boards 26 may also be otherwise suitably attached such as by screws, nails, or other fasteners. The backer boards 26 may, for example, be Dens-Shield gypsum boards marketed by Georgia-Pacific Gypsum LLC of Atlanta, Ga., having a thickness of, for example, ¼ inch. It should be understood that, alternatively, the floor 21 may be a hardwood or concrete floor or a stronger and more rigid wood substrate which does not include the backer boards. For example, the floor 21 may include a substrate of ⅝ inch douglas fir plywood to the upper surface of which is screwed or otherwise suitably attached ⅝ inch plywood.

In accordance with the present invention, laid on top of the backer boards 26 are suitable sheets such as, for example, vinyl tiles 28, which are unattached to the backer boards 26. Thus, the sheets or vinyl tiles 28 are laid so as to "float" on the floor substrate 26, i.e., they are laid unattached to the floor substrate 26, whereby the thereafter laid ceramic tiles, as hereinafter described, can be easily and quickly removed for replacement by lifting the vinyl tiles 28, with the ceramic tiles attached, from the floor 21. The vinyl tiles 28 may, for example, be ⅛ inch vinyl composition 12 inch×12 inch tiles marketed by Olympia Tile of Toronto, Canada. Thinner vinyl tiles 28, which may be less expensive, may be used. For example, for application to a concrete floor 21, the vinyl tiles may be about 0.080 inch thick. Although laid loosely, the vinyl tiles 28 should be laid tightly together so that they are not able to move around.

The ceramic tiles 30 are laid onto the floating vinyl tiles 28 and bonded thereto by the aforesaid latex-modified thinset mortar 32, and suitable conventional grouting, illustrated at 34, applied between the ceramic tiles 30. The ceramic tiles 30 may, for example, be 16 inch square porcelain tiles. The tiles 30 are desirably porcelain (as opposed to other ceramic tiles) because porcelain tiles are more dense and stronger than the typical other ceramic tiles. The latex-modified thinset mortar 32 may, for example, be #52 polymer modified thinset mortar marketed by Olympia Tile of Toronto, Canada.

In order to install the backer boards 26, with the temperature at 65 degrees F. or greater, the backer boards 26, if used, or otherwise the surface of the floor substrate should be clean and free of any protrusions, bumps, or particles that may prevent the vinyl tiles 28 from lying flat, and the backer boards 26, if used, are suitably bonded with the thinset mortar 24 to the substrate 22. It is recommended that the seams of the backer boards 26 be patched with a thinset and latex add mix (latex-modified thinset mortar) that is intended to bond tile to vinyl, such as Mapei's Kerabond or Keralastic mortar, marketed by Mapei of Liverpool, N.Y., and the patch fan-dried for a minimum of 60 minutes.

In order to install the tiled floor 20, The vinyl tiles 28 are laid closely adjacent to each other with no glue or other bonding agent holding them to the surfaces of the backer boards 26 (or floor substrate, if no backer boards are used), whereby the vinyl tiles 28 "float" on the backer boards or substrate. A heat gun may be used to form the vinyl tiles 28 to the backer boards 26 (or floor substrate) in areas that are slightly uneven. Masking tape is applied to hold the vinyl tiles 28 together so they do not separate and create gaps. A suitable double-faced tape is applied underneath the vinyl tiles 28 along the edges of the floor to also prevent shifting and separation. A ¼ inch to ½ inch gap should be left around all edges of the floor to allow the room to expand and contract without causing the tile to buckle, and this gap should accordingly not be filled with thinset mortar or grout. The ceramic tiles 30 are then laid and bonded to the vinyl tiles 28 with the latex-modified thinset mortar 32 and then suitably grouted after they have properly set up.

A ceramic tiled floor similar to tiled floor 20 has been installed experimentally in my tile store showroom for over 10 years, without my imparting to my customers the nature thereof, as a means of testing how long such a floor would hold up under normal use subjected to light foot traffic. To outward appearances, the floor has had the appearance of a normal ceramic tile floor. It is therefore believed that my customers and the public did not ever become aware of the experimental nature of the floor. While the floor has successfully withstood the light floor traffic in the showroom with no cracks in the ceramic tile, it did develop cracks when tested by the Tile Council of America. It is believed that movement of the loosely laid vinyl tiles underneath the ceramic tiles may have contributed to the tile cracking. Thus, for heavier foot traffic, there still has existed a need for an improved method and articles for laying an easy to install and remove durable ceramic tile floor, and such improvements will hereinafter be discussed.

Figure 2:
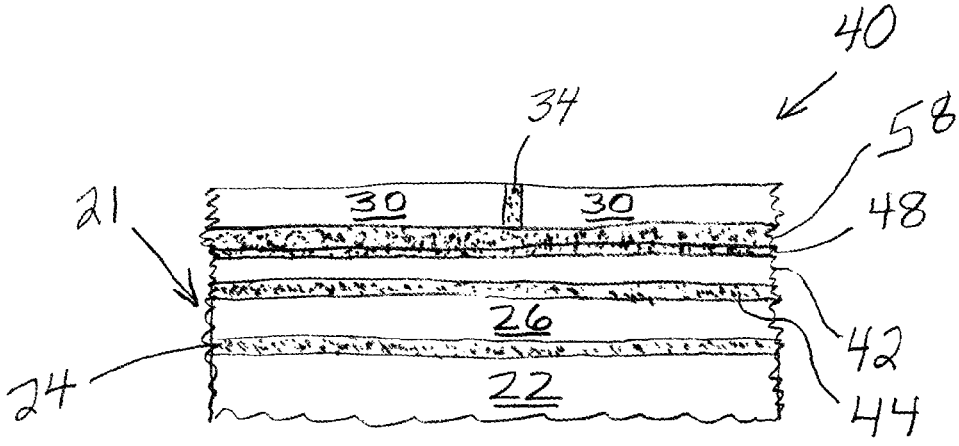
FIG. 2 is a view similar to that of FIG. 1 of a portion of flooring in accordance with an alternative embodiment of the present invention, wherein the flooring substrate includes backer board.

Referring to FIG. 2, there is shown generally at 40 a tiled floor for withstanding heavier foot traffic. The floor substrate 21 includes a wood floor 22 to which backer boards 26 have been suitably bonded with the aforesaid latex-modified thinset mortar 24 and/or otherwise suitably attached similarly as described for the floor of FIG. 1. In order to achieve the desired stability underneath the ceramic tiles, sheets 42 (discussed hereinafter) are suitably bonded to the backer boards 26 with a suitable adhesive 44 (discussed hereinafter), and the ceramic tiles 30 are suitably bonded to the sheets 42 as hereinafter described and suitably grouted as illustrated at 34.

Figure 3:
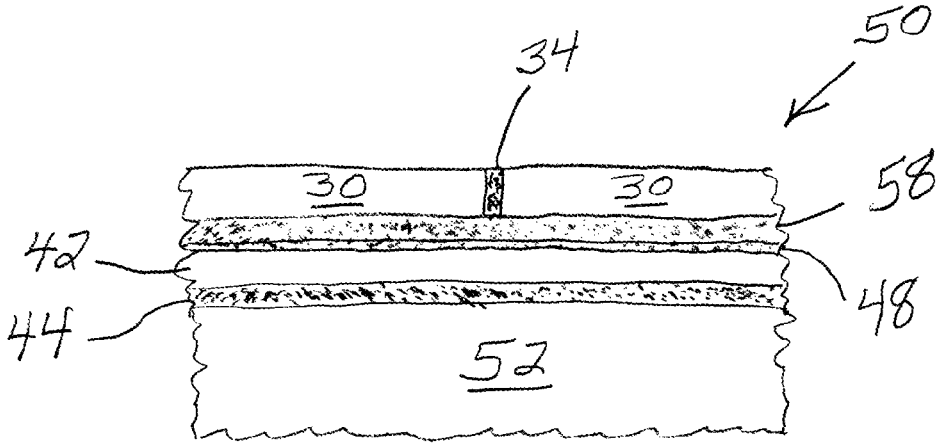
FIG. 3 is a view similar to that of FIG. 1 of a portion of flooring in accordance with the alternative embodiment of the present invention, wherein the flooring substrate is concrete and does not include backer board.

Referring to FIG. 3, there is shown generally at 50 a tiled floor wherein the floor substrate 52 is concrete or other suitable substrate not requiring backer boards for strengthening thereof. The sheets 42 are accordingly bonded with the adhesive 44 directly to the concrete floor substrate 52 to thereby provide the desired stability underneath the ceramic tiles. Otherwise, the tiled floor 50 is similar to the tiled floor 40.

In order to allow easy and quick removal of the ceramic tiles 30, the sheet 42 is composed of paper or other suitable material which, while affording the desired stability under normal conditions of floor use, can tear apart or separate thus allowing the "peeling" of the ceramic tiles 30 from the floor substrate when it is desired to remove the ceramic tiles 30. The sheet 42 may, if desired, be pre-perforated or perforated (slitted) at the time of application at spaced locations (for example, every 9 to 12 inches) to allow accelerated curing time and/or easier removal of the tile 30.

Figure 6:
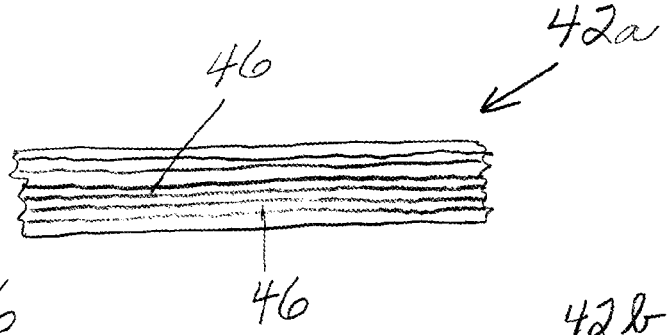
FIG. 6 is a view similar to that of FIG. 1 of an enlarged view of a sheet for the article.

Referring to FIG. 6, a preferred sheet 42 is sheet 42*a* which comprises a plurality of layers 46 of paper bonded together so that the layers 46 will separate one from another for removal of the ceramic tiles 30 from the floor substrate. An example of a suitable sheet 42*a* is Fiberock floor protection paper, which is a 12-point quality paper board marketed by United States Gypsum Company (USG) of Chicago, Ill. This paper, which has 7 layers 46 and an thickness of about 1/32 inch or less and with water resistance integral in all layers, is made in a wet slurry process formed by heat and pressure using a conventional paper rolling process that bonds the layers together. This paper, which is sold in 3 feet by 167 feet rolls, has conventionally been used for taping to a brand new floor (tile or wood) to protect it from damage while a home is being sold. It has a white side and a brown side. The white side should desirably face downward and is bonded to the floor substrate with the adhesive 44, which may be a suitable permanent adhesive. The brown side should desirably face upward since it has been found to appear to better receive the thinset mortar. Alternatively, when applied to backer board, it may be desired that the brown side face downwardly so as to provide better adherence between the paper and the backer board when the paper and backer board are assembled together for sale as a unit, it being found that the brown side appears to provide better adherence. The bonding of the paper layers 46 is desirably weaker than the bonding of the sheet to the floor substrate and to the ceramic tiles 30. Accordingly, when the ceramic tiles 30 are removed, the paper 42*a* separates such that some layers 46 remain with the floor substrate and others of the layers 46 remain with the ceramic tiles 30. Advantageously, it is then only necessary to make minor repairs to the backer board, wood, or concrete substrate, patch, and sand slightly in order to prepare the substrate to accept new tile.

Figure 7:
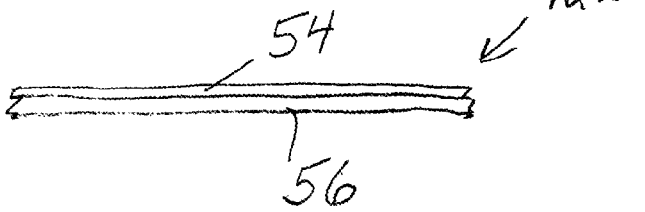
FIG. 7 is a view similar to that of FIG. 6 of an alternative embodiment of the sheet for the article.

Referring to FIG. 7, another suitable sheet 42 is a paper 42*b* (such as, for example, Polykraft paper) which is a coating 54 (about 0.0005 mil) of polyethylene film adhesively bonded (heat laminated) to a single layer 56 (or multiple layers) of suitable paper (for example, 50# Kraft paper, supplied by various suppliers including Chudy Paper of Buffalo, N.Y.). The Polykraft paper is believed to be water resistant. The sheet 42*b* may have a thickness of, for example, about 1/32 inch or less. Its polyethylene side 54 faces the ceramic tile 30 because polyethylene bonds well to thin-set mortar, and its paper side 56 is bonded to the floor substrate with the adhesive 44, which may be a suitable permanent adhesive. For easy removal of the ceramic tile 30, the adhesive laminating the polyethylene to the paper is desirably weaker than the bonding of the sheet 42 to the floor substrate and to the ceramic tiles 30, whereby the polyethylene coating may advantageously separate from the Kraft paper. Alternatively, the paper side 56 may face the ceramic tile 30, and the polyethylene side 54 may be bonded to the floor substrate with the adhesive 44, which may be a suitable releasable adhesive, whereby the sheet 42*b* may be advantageously peeled from the floor substrate. Either way, advantageously, it should then only be necessary to make minor repairs to the substrate, patch, and sand slightly in order to prepare the substrate to accept new tile. Polykraft paper is sold in widths of about 3 feet and lengths of about 600 feet.

Another suitable sheet 42 is the above discussed Polykraft paper and a releasable adhesive, such as Taylor's 2027 adhesive marketed by W. F. Taylor Co., Inc. of Dalton, Ga., is used to apply the paper to the substrate, whereby the laid ceramic tile 30 may be easily removed by peeling the paper from the substrate. The sheets of Polykraft paper should be laid into the adhesive with the shiny polyethylene side down.

Another suitable sheet 42 is a 6 feet wide membrane known as an Underfloor membrane marketed by Congoleum of Mercerville, N.J. and which comprises a combination of fibrous felt and pvc (polyvinylchloride) vinyl. Another suitable sheet is a 6 feet wide membrane known as a mul membrane ("mul" is also a fibrous felt and pvc vinyl combination) which is marketed by Mannington of Salem, N.J.

In order to lay the ceramic tiled floor, with the substrate surface clean and dry and the temperature at 65 degrees F. or greater, the sheet 42 is suitably adhesively applied to the floor substrate, using a permanent or releasable adhesive 44. For application of the aforesaid Polykraft paper, use a flat edged trowel or putty knife to spread out the Taylor's 2027 adhesive, then use a short nap roller to even it out on the substrate, then use a fan to dry the adhesive (usually takes 20 to 30 minutes, the adhesive will change from a creamy color to a clear transparent state; if you touch it with your finger tips and it transfers to your fingers, it is not dry). For application of sheets 42*a* and 42*b*, use a 1/16 inch square notch trowel to spread a multipurpose flooring adhesive such as Apac's #240, let the moisture wick off by letting the adhesive stand for about 10 minutes. After the respective adhesive is dry, roll out the respective sheet (42*a* or 42*b* or Polykraft) into the adhesive with the appropriate side (as previously discussed) up. Use a flat trowel to press the sheet into the adhesive while pressing out all air bubbles to the sides. Be sure edges of seams are flat, and do not let the seams of the sheets fall directly over any seams of the backer boards or other substrate seams. A knife may be used to puncture any air bubbles that won't come out. The sheets 42*a* and 42*b* should stand for about 10 minutes before setting tile, but the tile may be set immediately after the Polykraft paper has been set in place. A primer coat of suitable adhesive 48 may then be applied to the sheet 42 so that the sheet 42, if non-porous, may accept the bondant 58. If the sheet 42 is porous, then it may not be necessary to apply the primer adhesive 48. After the primer adhesive 48 has dried (or if no primer adhesive is applied due to the sheet 42 being sufficiently porous to accept the bondant 58), then the ceramic tiles 30 may be bonded to the sheet 42 by applying the bondant 58, which is desirably a thinset and latex add mix (latex modified thinset mortar) that is intended to bond tile to vinyl, such as the aforesaid Mapei's Kerabond or Keralastic mortar. The mortar should have suitable body or applied thickness to bond the ceramic tiles 30 in place. The ceramic tiles 30 are then suitably set into the mortar 58 suitably adjacent each other and allowed to set up, and, after waiting 48 hours, suitable grouting 34 is applied.

Figure 4:
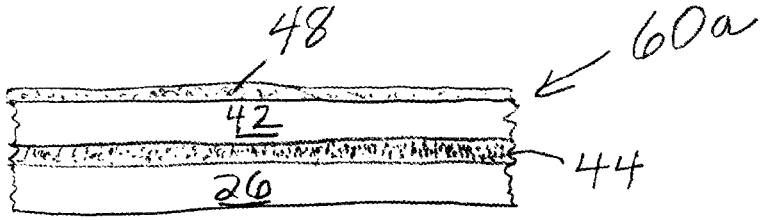
FIG. 4 is a view similar to that of FIG. 1 of a portion of an article for application to flooring in accordance with the present invention.
Figure 5:
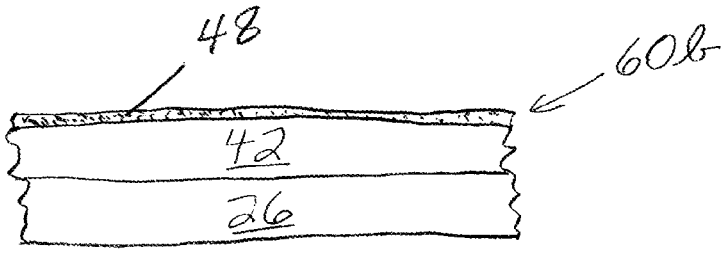
FIG. 5 is a view similar to that of FIG. 1 of a portion of an alternative embodiment of the article.

Referring to FIG. 4, in accordance with the present invention, in order to make the installation of the ceramic tiles 30 easier, an article, illustrated generally at 60*a*, may be provided to a consumer in which the sheet 42 has been pre-applied with the adhesive 44 to a backer board 26. Referring to FIG. 5, an alternative article 60*b* comprises the sheet 42 pre-applied to the backer board 26 by bonding them together in a slurry state wherein the adhesive is not used. If the sheet 42 is non-porous, the primer adhesive 48 may also be pre-applied thereto (but is not required); otherwise, the primer adhesive may not be necessary. In order to install the ceramic tiles 30, the customer may apply the backer board portion of the article 60 (either 60*a* or 60*b*) to the floor substrate 22 using the thinset mortar 24 similarly as previously discussed with respect to FIG. 2, then the ceramic tiles 30 may be applied to the sheet portion of the article 60 (either 60*a* or 60*b*) using the thinset mortar 58 and, if necessary, the primer adhesive 48, as also previously discussed. Thus, the customer is desirably spared the time-consuming step of applying the sheet 42 to the backer board 26 and may also be spared the time-consuming step of applying the primer adhesive.

Referring to FIG. 8, in accordance with an alternative embodiment tiled floor 70 of the present invention, an adhesive tape 72 is suitably applied to the backer board 26, and the ceramic tiles 30 are suitably bonded to the tape 72 using the thinset or other suitable mortar as previously discussed. Alternatively, as illustrated in FIG. 9, the adhesive tape 72 may be applied to a hardwood floor 74. As best seen in FIG. 10, the tape 72 includes a strip 76 of suitable material to which has been pre-applied a suitable adhesive 78. While the primer adhesive 48 may be pre-applied, it is preferred that the customer spray it on after the tape has been applied.

The tape strip 76 may be composed, for example, of polyethylene, which may have a thickness of, for example, 5 to 6 mils, or other suitable plastic material. Another suitable tape strip 76 is aluminum foil, which may have a thickness of, for example, 2 mils. The tape strip 76 may also be composed, for example, of rubber or synthetic rubber or other suitable material.

In order to not damage the hardwood floor 74 or other floor to which the adhesive tape 72 is applied and in order to allow easy and quick removal of the laid tiled floor, in accordance with the present invention, the adhesive 78 is a releasable or removable adhesive. Such adhesives are provided to form temporary bonds and, in preferred forms, can be removed after months or years without leaving other than perhaps a small amount of residue on the adherent. They are used in applications such as surface protection films, masking tapes, bookmark and note papers, price marking labels, promotional graphics materials, and skin contact (i.e, wound care dressings, EKG electrodes, athletic tape, etc.). Such adhesives have low adhesion and generally cannot support much weight, but they are considered to provide sufficient adhesion for providing the needed stability for the tiled floors of the present invention. Examples of releasable adhesives include the aforesaid Taylor's 2027 adhesive and Mannington's MT711 adhesive. The releasable adhesive 78 releases best from non-porous surfaces such as a urethane-finished wood or polyethylene-finished wood or other non-porous or high gloss hardwoods or substrate surfaces. Accordingly, a urethane or polyethylene or other high gloss finish should desirably be applied to a substrate before the tape 72 is applied thereto. As used herein and in the claims, a releasable adhesive is one which dis-adheres or releases from the adherent upon application of moderate or minimal peeling force to the tape and thus forms a non-permanent bond. In contrast, a contact or self-stick adhesive (which may or may not be releasable) may be of a type which forms a permanent or non-removable bond and should therefore not be considered to be a releasable adhesive.

Suitable adhesive aluminum foil tape 72 may, for example, be a 2-mil thick aluminum foil tape, marketed by Walco Corporation of Glenshaw, Pa., with acrylic adhesive having an adhesion strength to steel of about 40 ounces per inch so that the tape is releasable. Another suitable aluminum foil tape 72 may, for example, be aluminum foil tape #425 (ID #70-0063-8599-4) marketed by 3M corporation and having a suitable releasable adhesive and provided in widths up to 40 inches, and typically used for heat protection around duct work.

The adhesive tape 72 should desirably be wide enough to make application efficient but not so wide that it is unwieldy. In accordance with the present invention, the adhesive tape 72 has a width, illustrated at 81 in FIG. 11, which is between about 22 and 44 inches, for example, about 30 inches. While the length, illustrated at 82, is not critical, the length 82 may, for example, be about 80 feet.

In order to form the ceramic tiled floor 70 or 80 using the releasable adhesive tape 72, with the substrate surface clean and dry and with the temperature at 65 degrees F. or more, proceed to cover the substrate surface with the releasable adhesive tape 72, taking care not to let the seams of the tape fall directly over any backer board or wood seams, but it is OK to overlap the edges of the tape. Although it is OK to lift and reposition the tape in order to remove bubbles, it is suitable to just puncture a bubble with a knife, and it is unnecessary to remove very tiny air bubbles. Too much lifting and repositioning of the tape may jeopardize the bonding quality of the adhesive. Use a very slightly damp rag or sponge to wipe off any dust or dirt, and use a wire brush to scuff up the surface of the tape while pushing out most of the remaining air bubbles and pressing the tape into the substrate more securely. The tape may then be immediately sprayed with the primer adhesive 48 and the adhesive allowed to dry. Then apply the thinset mortar and lay the ceramic tile 30 in place. It is recommended that the mortar be the aforesaid thinset and latex add mix that is intended to bond tile to vinyl, such as Kerabond mortar and Keralastic latex add mix marketed by Mapei of Liverpool, N.Y. It is recommended to then wait 48 hours before grouting.

Figure 12:
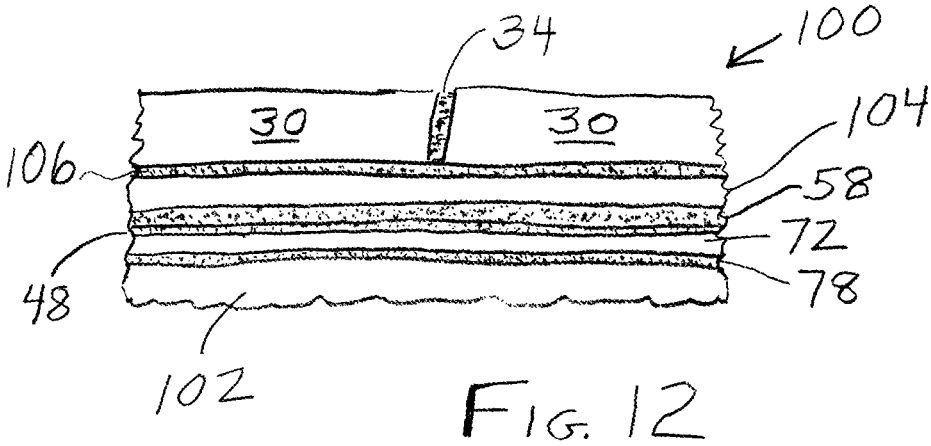
FIG. 12 is a view similar to that of FIG. 1 of a portion of flooring in accordance with the another embodiment of the present invention, wherein the flooring substrate is hardwood.

Referring to FIG. 12, there is illustrated generally at 100 flooring in which the ceramic tiles 30 are applied to a hardwood floor 102. A hardwood floor may require the addition of a strengthening membrane in order to have sufficient strength for the application of the ceramic tiles 30. Yet the use of nails for applying backer board to a hardwood floor would damage the hardwood. In order to prevent such damage, in accordance with the present invention, the tape 72 is releasably bonded directly to the hardwood floor 102, as previously discussed, and a suitable strengthening membrane 104 is suitably bonded to the tape 72 (to which the primer adhesive 48 is applied, if needed). A suitable membrane 104 may be Ditra matting marketed by Schluter Systems L.P. of Plattsburg, N.Y., and it may be bonded to the aluminum tape 72 with the thinset mortar 58, which may, for example, be #254 mortar provided by Laticrete International Inc. of Bethany, Conn. or may be the aforesaid Mapei Kerabond mortar with Keralastic latex add mix. The ceramic tiles 30 are then suitably bonded to the membrane 104 with bondant 106, which may, for example, be the Mapei Kerabond mortar with no add mix, and suitably grouted. In order to remove or replace the ceramic tiles 30 at a date months or years later, the tiles 30 along with the membrane 104 are stripped from the tape 72. The tape 72 is then removed without leaving other than perhaps a small amount of residue, which is then removed. Since no nails or screws or mortar is used during installation of the ceramic tiles 30, the hardwood floor 102 desirably need only be suitably sanded and refinished for use.

Figure 13:
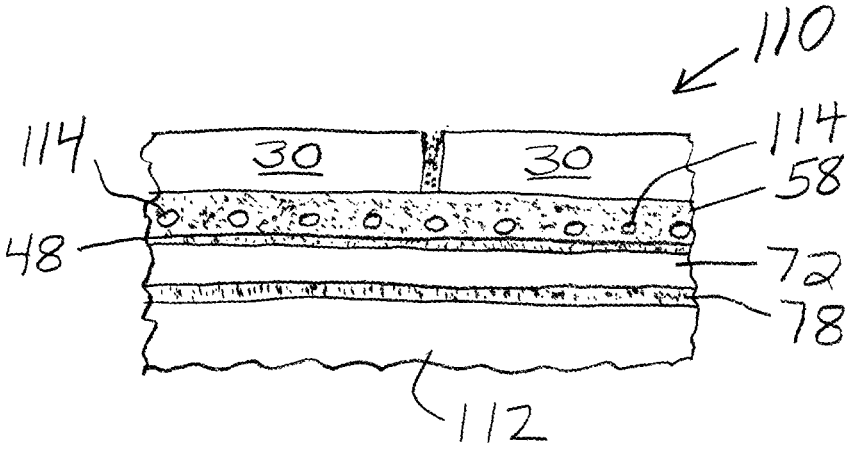
FIG. 13 is a view similar to that of FIG. 1 of a portion of flooring in accordance with the another embodiment of the present invention.

Referring to FIG. 13, there is illustrated generally at 110 heated flooring in which the ceramic tiles 30 are applied to any suitable floor substrate, illustrated generically at 112. An electric heating system illustrated by wires 114 but which may be in any other suitable form such as matting is provided to underlie the ceramic tiles 30 for heating thereof. In order to increase the efficiency of the heating system 114, in accordance with the present invention, the aluminum foil tape 72 is applied to the floor substrate 112 to underlie the heating system 114 so that the heat reflective qualities of the aluminum foil tape can prevent or reduce heat loss by preventing or reducing heat from being absorbed into the substrate 112. While the heating system 114 is illustrated within the thinset mortar 58 (which may be latex-modified), it should be understood that it may otherwise be suitably installed within the ceramic tile flooring 110. While the tape 72 for this purpose is described as aluminum tape, it should also be understood that it may be any other suitable tape having the desired heat reflective qualities and may be suitably applied to the substrate 112 otherwise than by the releasable adhesive 78.

In accordance with the present invention, there is provided, as described heretofore, a method for laying ceramic tiles which comprises providing an article comprising a tile backer board with a sheet bonded to the backer board wherein the sheet comprises a plurality of layers bonded together, attaching the backer board to a floor substrate, and bonding ceramic tiles to said sheet, wherein separation of the sheet along layers thereof is effected for removal of laid ceramic tiles from the backer board.

In accordance with the present invention, there is provided, as described heretofore, a method for laying ceramic tiles which comprises bonding a sheet comprising a plurality of layers bonded together to a tile backer board, attaching the backer board to a floor substrate, and bonding ceramic tiles to the sheet, wherein separation of the sheet along layers thereof is effected for removal of laid ceramic tiles from the backer board.

In accordance with the present invention, there is provided, as described heretofore, a method for laying ceramic tiles which comprises bonding a sheet comprising a plurality of layers bonded together to a floor substrate, and bonding ceramic tiles to the sheet, wherein separation of the sheet along layers thereof is effected for removal of laid ceramic tiles from the floor substrate.

In accordance with the present invention, there is provided, as described heretofore, a method for laying ceramic tiles which comprises releasably bonding a tape having a releasable adhesive thereon to a floor substrate, and bonding at least one ceramic tile to the tape. The tape is desirably aluminum tape. The tape desirably has a width which is at least about 22 inches. The tape desirably has a width which is between about 22 and 44 inches. The tape is of particular desirability for hardwood floor substrates wherein nails, screws, or other fasteners may cause damage to the hardwood.

In accordance with the present invention, there is provided, as described heretofore, a method for laying ceramic tiles which comprises laying a sheet on a floor substrate so that it floats on the floor substrate, and bonding at least one ceramic tile to the sheet.

In accordance with the present invention, there is provided, as described heretofore, in combination with a floor substrate such as hardwood, at least one sheet laid on the floor substrate and which floats on the floor substrate, and at least one ceramic tile bonded to said sheet.

It should be understood that, while the present invention has been described in detail herein, the invention can be embodied otherwise without departing from the principles thereof, and such other embodiments are meant to come within the scope of the present invention as defined by the appended claims.

What is claimed is:

1. A method for laying ceramic tiles comprising the steps of (a) attaching at least one sheet comprising a plastic layer and at least one other layer bonded together to a floor substrate, and (b) bonding at least one ceramic tile to the sheet after the sheet has been attached to the floor substrate, wherein the bonding strength of the layers together is less than the strength of attachment of the sheet to the floor substrate or to the tiles thereby to thereafter allow removal of said bonded ceramic tiles from the floor substrate by separation of said sheet between two of said layers, wherein the step of attaching of the at least one sheet to a floor substrate comprises providing at least one article of manufacture comprising a tile backer board with the sheet bonded to the backer board and attaching the backer board to an existing floor.

2. A method for laying ceramic tiles comprising the steps of (a) providing for the bonding to a floor substrate of at least one sheet comprising a plurality of layers bonded together including a plastic layer, and (b) bonding at least one ceramic tile to the sheet after the sheet has been bonded to the floor substrate, wherein the strength of bonding of the layers together is less than the strength of bonding of the sheet to the floor substrate or to the tiles to thereafter allow removal of said bonded ceramic tiles from the floor substrate by separation of said sheet between at least two layers, wherein the step of bonding the ceramic tile to the sheet includes applying a mortar to the sheet and laying the ceramic tile in the mortar.

3. A method according to claim 2 wherein the step of bonding the ceramic tile to the sheet further includes applying an adhesive to the sheet before applying the mortar to the sheet.

4. A method according to claim 2 wherein said plurality of layers further includes at least one layer composed of paper.

5. A method according to claim 2 wherein the plastic layer comprises a polyethylene film, and the plurality of layers further comprises at least one layer of paper.

6. A method according to claim 1 wherein the step of bonding at least one ceramic tile to the sheet comprises bonding the at least one ceramic tile to the plastic layer.

7. A method according to claim 1 wherein the step of bonding at least one ceramic tile to the sheet comprises applying a mortar to the sheet and laying the ceramic tile in the mortar.

8. A method according to claim 2 wherein the step of applying a mortar to the sheet comprises applying the mortar to the plastic layer of the sheet.

9. An article of manufacture for applying to a floor substrate for preparing the floor substrate for laying of ceramic tiles by bonding ceramic tiles to the article after the article is applied to the floor substrate, the article of manufacture being unattached to either the floor substrate or the floor ceramic tiles and comprising a tile backer board for application to the floor substrate and a sheet bonded to said backer board for thereafter bonding of the ceramic tiles to said sheet, said sheet comprising a plurality of layers and further comprising means for bonding said layers together with a bonding strength which is less than the strength bonding said sheet to said backer board for thereafter effecting removal of said bonded ceramic tiles from said backer board by separation of said sheet between two of said layers, wherein said layers comprise a plastic layer and at least one other layer.

10. An article according to claim 9 wherein said at least one other layer is composed of paper.

11. An article according to claim 9 wherein said plastic layer comprises a polyethylene film and said at least one other layer comprises at least one layer of paper.

12. An article according to claim 9 further comprising an adhesive applied to said sheet to allow a bondant to bond said ceramic tiles to said sheet.

13. An article according to claim 9 wherein said at least one other layer is received between said backer board and said plastic layer, whereby said plastic layer is positioned for thereafter bonding of ceramic tiles thereto.

* * * * *